United States Patent [19]

Suzuki

[11] Patent Number: 4,721,485

[45] Date of Patent: Jan. 26, 1988

[54] FLYWHEEL MAGNETO COVER FOR MARINE PROPELLER ENGINE

[75] Inventor: Tomonori Suzuki, Hamamatsu, Japan

[73] Assignee: Sanshin Kogyo Kabushiki Kaisha, Japan

[21] Appl. No.: 920,932

[22] Filed: Oct. 17, 1986

Related U.S. Application Data

[63] Continuation of Ser. No. 643,657, Aug. 23, 1984, abandoned.

[30] Foreign Application Priority Data

Aug. 24, 1983 [JP] Japan ..... 58-153148

[51] Int. Cl.[4] ..... B63H 21/00

[52] U.S. Cl. ..... 440/77; 440/76; 123/195 P

[58] Field of Search ..... 440/76, 77, 85; 123/195 P, 198 E, 195 C

[56] References Cited

U.S. PATENT DOCUMENTS

| | | | |
|---|---|---|---|
| 1,727,086 | 9/1929 | Vastano | 440/85 |
| 2,835,241 | 5/1958 | Brooks | 440/85 |
| 2,890,674 | 6/1959 | Rose | 440/77 |
| 3,365,093 | 1/1968 | Malenke | 411/435 |
| 3,570,465 | 3/1971 | Masaosk | 440/77 |
| 4,114,506 | 9/1978 | Aimar | 411/435 |
| 4,135,470 | 1/1979 | Ono | 440/77 |
| 4,348,194 | 9/1982 | Walsh | 440/77 |
| 4,452,194 | 6/1984 | Watanabe | 123/195 P |
| 4,493,661 | 1/1985 | Iwai | 123/195 P |

*Primary Examiner*—Joseph F. Peters, Jr.
*Assistant Examiner*—Clifford T. Bartz
*Attorney, Agent, or Firm*—Ernest A. Beutler

[57] ABSTRACT

Two embodiments of flywheel covers for outboard motors that are readily removable from their connection to the motor without special tools so as to facilitate emergency starting.

8 Claims, 13 Drawing Figures

FLYWHEEL MAGNETO COVER FOR MARINE PROPELLER ENGINE

This is a continuation of U.S. patent application Ser. No. 643,657, filed Aug. 23, 1984, now abandoned.

BACKGROUND OF THE INVENTION

This invention relates to a flywheel magneto cover for a marine propulsion engine and more particularly to an improved and simplified flywheel cover arrangement for an outboard motor.

As is well known, it is the practice to cover the engine of an outboard motor with a surrounding protective cowling. In addition, the flywheel of the engine is also protected by an internal cowling member that is fixed in some suitable manner to the engine. However, it it necessary to provide some arrangement for emergency starting the engine in the event the normal starting device (either the conventional recoil starter or an electric starter) fails. Such emergency starting mechanisms comprise the provision of a pulley portion on the flywheel around which a starter rope may be trained so as to permit emergency starting. However, the previously proposed flywheel protective covers have been of the type that have required either a screwdriver or some other form of tool to remove before the manual, emergency starting can be accomplished. Quite frequently, the operator will not have a screwdriver on his person and thus it will be impossible for him to provide the emergency starting routine.

It is, therefore, a principal object of this invention to provide an improved and simplified flywheel cover for an engine.

It is another object of this invention to provide an improved, simplified flywheel cover that may be removed for emergency starting without the use of tools.

SUMMARY OF THE INVENTION

This invention is adapted to be embodied in a cowling arrangement for the power head of an outboard motor or the like that comprises an internal combustion engine having an output shaft carrying a flywheel. An outer cowling encloses the engine and has a readily removable portion disposed contiguous to the flywheel. A flywheel cover encloses the flywheel and is detachably connected to the engine independently of the readily removable outer cowling portion for retention thereof relative to the engine upon removal of the readily removable outer cowling portion. In accordance with the invention, the flywheel cover is detachably connected to the engine for removal without the use of any tool.

DETAILED DESCRIPTION OF THE PREFERRED EMBODIMENTS

Embodiment Of FIGS. 1 Through 8

Figure 1:
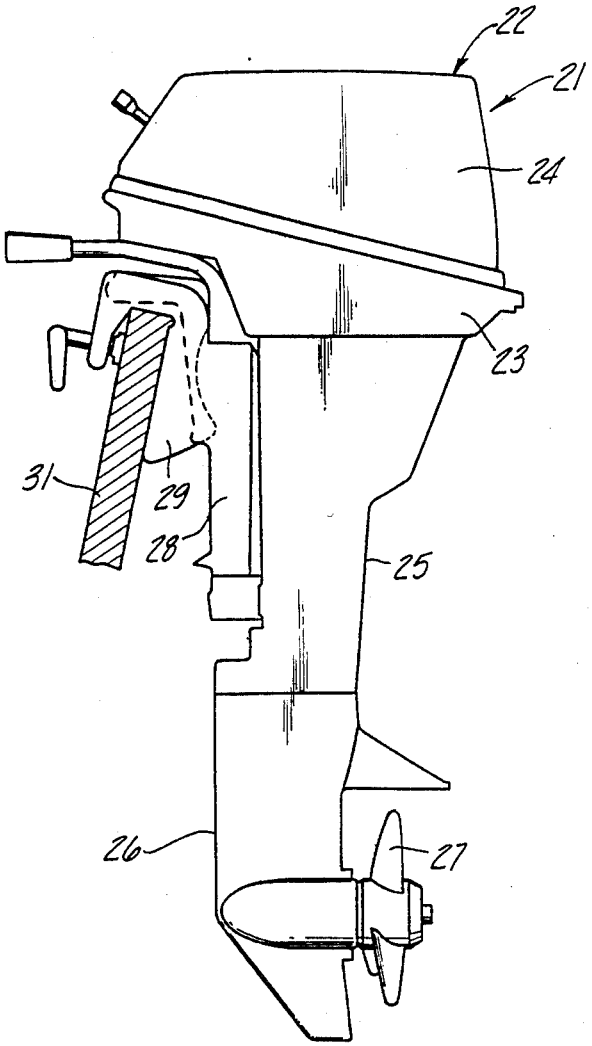
FIG. 1 is a side elevational view of an outboard motor constructed in accordance with an embodiment of the invention as attached to the transom of an associated watercraft.

Referring first to FIG. 1, an outboard motor constructed in accordance with an embodiment of the invention, is identified generally by the reference numeral 21. The motor 21 includes a power head, indicated generally by the reference numeral 22, and which, as will become apparent in connection with the description of the remaining figures, includes an internal combustion engine that is surrounded by a protective cowling comprises of a tray 23 and a main cover portion 24. A drive shaft housing 25 depends from the power head 22 and contains a drive shaft (not shown) that is driven by the engine of the power head 22 in a known manner. A lower unit 26 is connected to the drive shaft housing 25 and contains a forward, neutral, reverse transmission (not shown) for driving a propeller 27.

A swivel bracket 28 is affixed to the drive shaft housing 25 and journals the motor 21 for steering movement about a generally vertically extending steering axis in a known manner. The swivel bracket 28 is, in turn, pivotally connected to a clamping bracket 29 for tilting movement about a horizontally disposed tilt axis. The clamping bracket 29 is, in turn, affixed to a transom 31 of a watercraft in a known manner.

Figure 2:
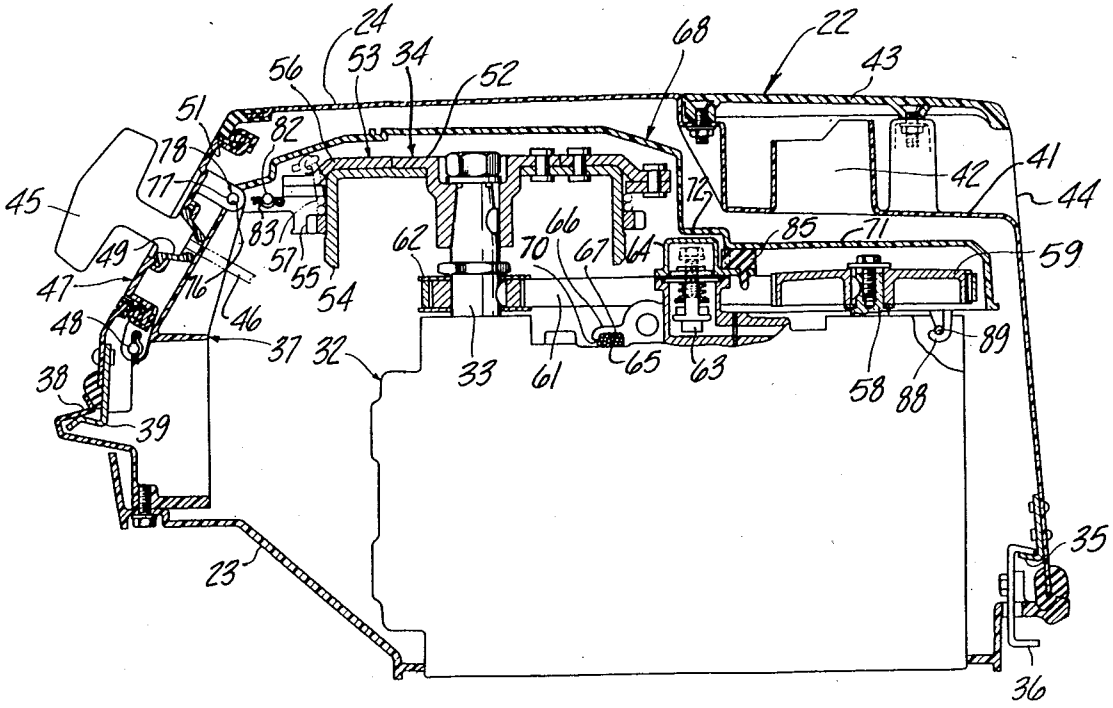
FIG. 2 is an enlarged, side elevational view, with portions shown in section, of the power head of the outboard motor.
Figure 3:
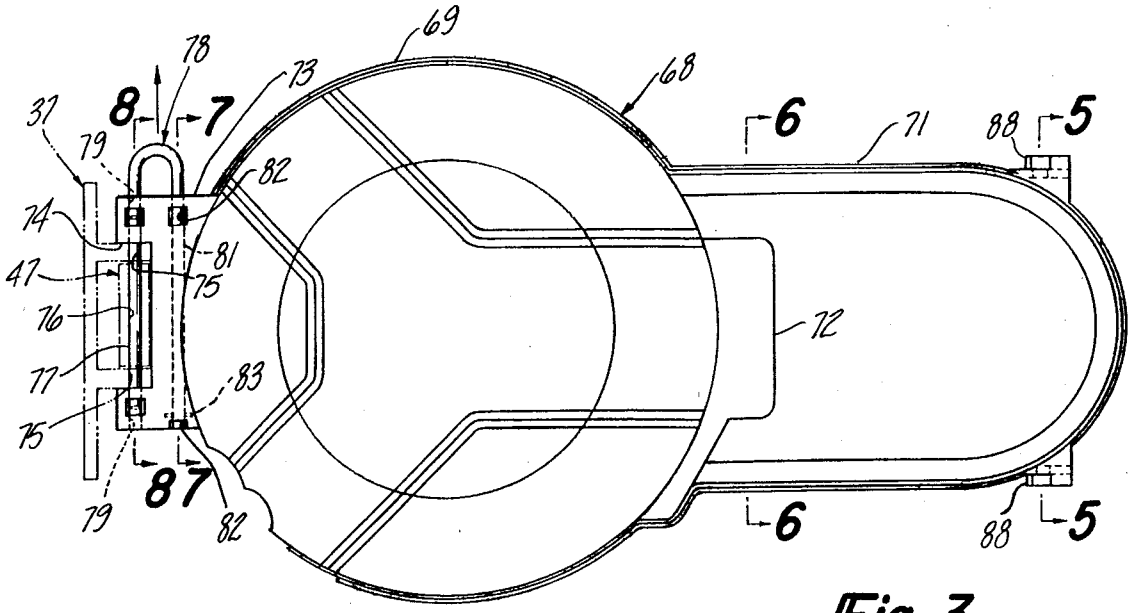
FIG. 3 is a top plan view showing the flywheel cover.
Figure 4:
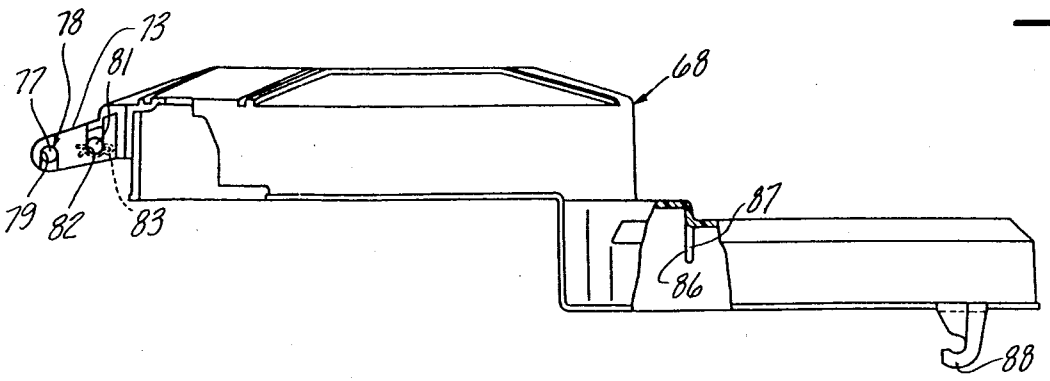
FIG. 4 is a side elevational view, with a portion broken away, showing the cover of this embodiment.
Figure 5:
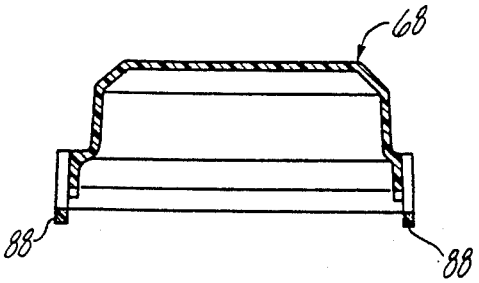
FIG. 5 is a cross-sectional view taken along the line 5—5 of FIG. 3.
Figure 6:
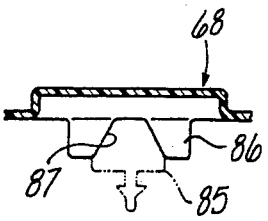
FIG. 6 is a cross-sectional view taken along the line 6—6 of FIG. 3.
Figure 7:
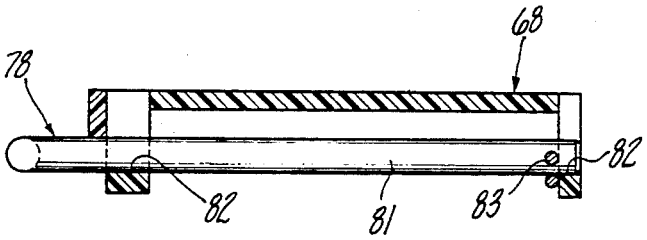
FIG. 7 is an enlarged, cross-sectional view taken along the line 7—7 of FIG. 3.
Figure 8:
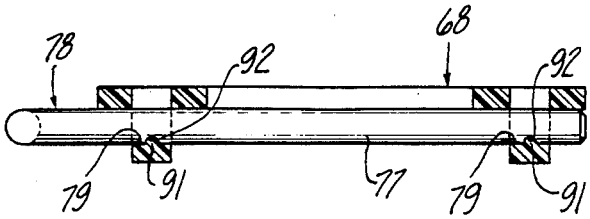
FIG. 8 is an enlarged, cross-sectional view taken along the line 8—8 of FIG. 3.
Figure 9:
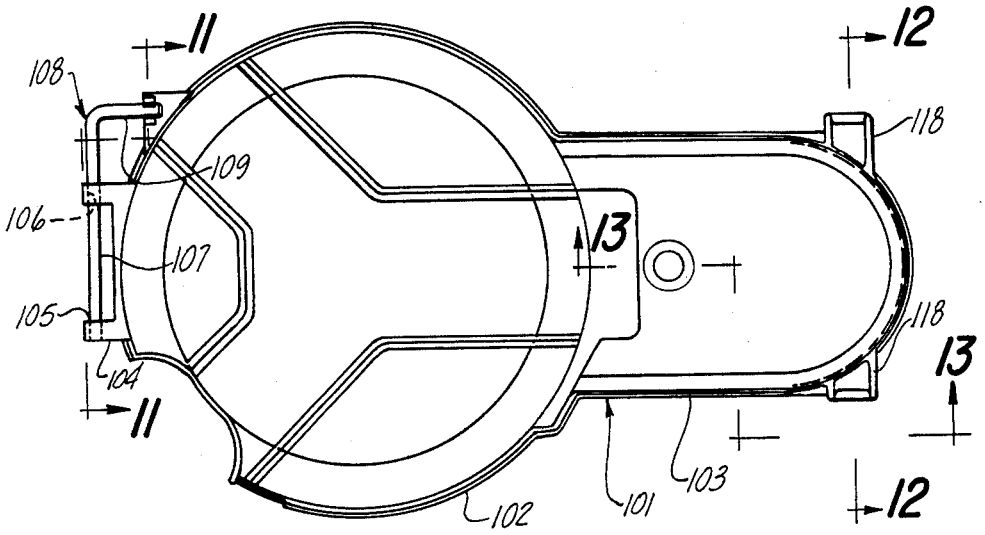
FIG. 9 is a top plan view, in part similar to FIG. 3, showing another embodiment of the invention.
Figure 10:
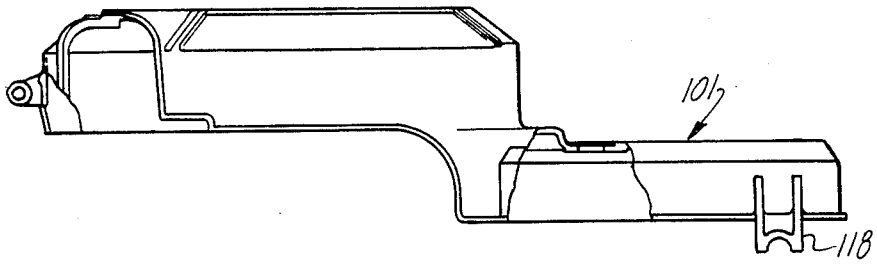
FIG. 10 is a side elevational view of the embodiment of FIG. 9.
Figure 11:
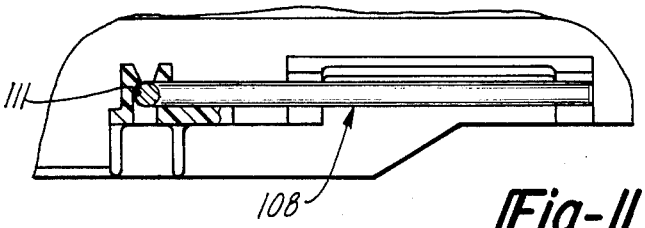
FIG. 11 is a cross-sectional view taken along the line 11—11 of FIG. 9.
Figure 12:
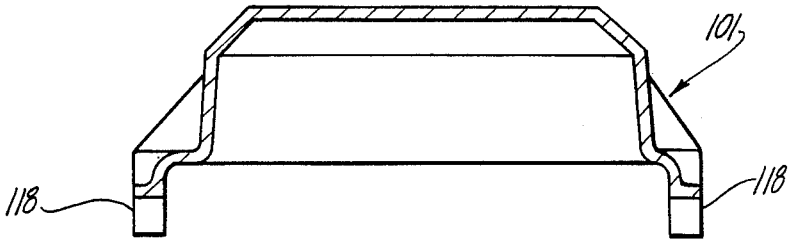
FIG. 12 is a cross-sectional view taken along the line 12—12 of FIG. 9.
Figure 13:
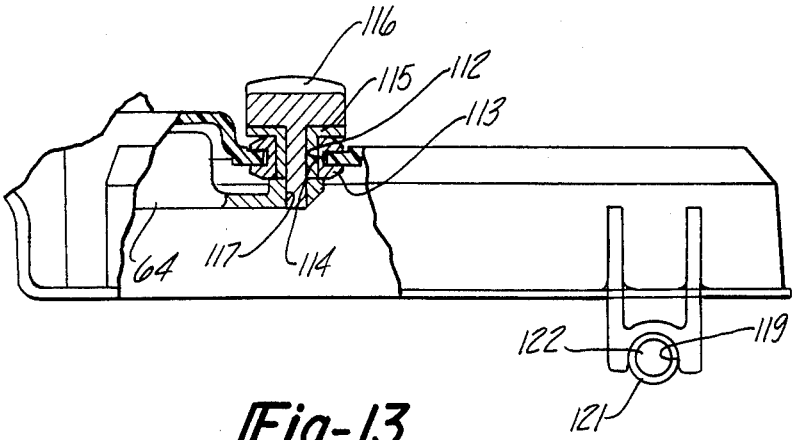
FIG. 13 is a cross-sectional view taken along the line 13—13 of FIG. 9.

Referring now to the remaining figures and particularly initially to FIG. 2, the engine of the power head 22 is shown primarily in elevation and is identified generally by the reference numeral 32. As is normal practice in conjunction with outboard motors, the engine 32 is disposed so that its output shaft 33 rotates about a vertically disposed axis. A flywheel magneto, indicated generally by the reference numeral 34, is affixed in a suitable manner to the exposed upper end of the engine output shaft 33.

The protective cowling, as has been previously noted, consists of the tray 23 and a main cover portion 24. These two components may be formed from a suitable material such as molded fiberglass and the tray 23 is affixed to the engine 32 in an appropriate manner. The main cover portion 24 includes a hook 35 formed at its rear end that cooperates with a movable latch member 36 so as to partially affix the main cover 24 to the tray 23. In addition, a supporting bracket assembly, indicated generally by the reference numberal 37, is affixed to the tray 23 and, accordingly, to the engine 32. The bracket assembly 37 has a rearwardly directed flange 38 at its forward portion which is engaged by one or more hooks 39 affixed to the main cover portion 24 so as to complete the attachment of the main cover portion 24 to the tray 23. The connection is such that the main cover portion 24 may be readily removed from the tray 23 to offer access to the engine 32 by releasing the latch 36 through its pivotal movement. Thus, the main cover portion 24 may be readily removed without the necessity of utilizing any tools or the like.

The internal cavity defined by the protective cowling and which encloses the engine 32 is provided with an air inlet which is comprised of a recessed central portion at the rear of the main cover 24, which recessed portion is identified by the reference numeral 41. An upstanding flange defines an air outlet opening 42 that extends from the recessed portion 41 into the interior of the protective cowling. A cover plate 43 extends across the mouth of the opening 42 and itself defines a rearwardly opening air inlet 44 that permits induction system air to be drawn into the engine 32 from the opening 44.

The engine 32 is provided with a recoil starter (not shown) so as to permit starting of the motor 32 by rotation of the output shaft 33. A starter knob 45 is connected to a rope 46 of the recoil starter. The starter knob 45 is supported by a support panel 47 which is affixed at its lower end to the supporting bracket 37 by means of a pin 48. The support panel 47 has an opening 49 through which the rope 46 may be drawn and which is engaged by a surface of the knob 45 when the starter knob 45 is in its normal position. The main cowling portion 24 is provided with an opening 51 that clears the supporting panel 47 so that the main cover portion 24 may be removed while the supporting panel 47 stays in place. A suitable seal is provided between the main cover portion 24 and the supporting panel 47 so as to preclude the entry of water through the opening 51.

The flywheel magneto 34 includes a hub portion 52 which, as has been previously noted, is non-rotatably affixed to the output shaft 33. A flywheel 53 is affixed to the hub portion and includes a depending flange 54 that provides a generally cup shape and which carries permanent magnets for the ignition system of the engine (not shown). In addition, the flywheel magneto may also include a generating system of any known type.

A ring gear 55 is affixed to the cup shaped portion 54 and specifically to its outer periphery so as to cooperate with the starter mechanism. Adjacent to the ring gear 55, the flywheel 53 is provided with a flange 56 which, coupled with the ring gear 55, provides a pulley groove around which a rope, shown in phantom and identified generally by the reference numeral 57, may be wound for emergency starting.

In the illustrated embodiment, the engine 32 is of the four-stroke type, although the invention or at least some facets of it are capable of use with engines operating on the two-stroke principle. As a four-stroke engine, the engine 32 includes a camshaft 58 that is journaled in the cylinder head in an appropriate manner. A driven sprocket 59 is affixed to the camshaft 58 and is driven by a belt 61 from a driving sprocket 62 that is affixed to the engine output shaft 33 adjacent to the flywheel magneto 34.

The engine 32 is also water cooled and its temperature is regulated by means of a thermostat 63 that is positioned in the cylinder block in the area between the driving and driven sides of the belt 61. A thermostat housing 64 encloses the area confined by the thermostat 63 and provides a suitable source of return for the coolant to the body of water in which the motor 21 is operating in an appropriate manner.

Adjacent to the thermostat housing 64, a series of wires 65 for the engine 32 pass across the upper face of the engine. The wires 65 are held in place by a harness retaining member 66 that has a recess 67 which is complementary to the shape of the wires 65 and engages them to hold them in place. An opening 70 is formed adjacent to the recess 67 so as to facilitate insertion and removal of the wires 65 from the recess 67.

In accordance with the invention, a combined flywheel belt and pulley cover, indicated generally by the reference numeral 68, is affixed to the upper side of the engine 32, in a manner to be described, and protects the flywheel assembly 34, belt 61, and pulleys 62 and 59. The cover 68 may be conformed conveniently from molded fiberglass or the like and has the configuration as best shown in FIGS. 3 through 8.

As seen in these figures, the cover 68 has a generally cylindrical portion 69 that extends around the flywheel magneto assembly 34. Projecting from one end of the section 69 at a lower level is a generally oval shaped part 71 that encircles the camshaft pulley 59, belt 61 and which has a recessed area 72 for clearing the thermostat housing 64. The portions 69, 71 and 72 are integrally formed with each other.

In accordance with the invention, the cover 68 is detachably affixed relative to the engine 32 so that it may be conveniently removed for manual starting without the necessity of utilizing any special tools. To achieve this, a mounting tab portion 73 is formed integrally with the cover portion 69 and extends axially in the direction opposite to the portion 71. The mounting tab portion 73 is formed with a recess 74 that clears the mounting bracket 37 which, as has been previously noted, is affixed to the engine 32 through the tray 23. In addition, the mounting panel 47 extends into the recess 74 and is positioned between inwardly extending legs of the mounting bracket 37. These legs are formed with apertures 75 which are aligned with a corresponding aperture 76 formed in the panel 47. One leg 77 of a U shaped retaining pin, indicated generally by the reference numeral 78, passes through the apertures 75 and 76 so as to provide support for the upper end of the panel 47 relative to the supporting bracket 37. The leg 77 also passes through a pair of similarly aligned apertures 79 formed in the cover mounting tab 73 so as to affix the cover mounting tab and the cover 68 to the engine 32 via the bracket 37.

The pin 78 has a second leg 81 that passes through an elongated opening 82 formed in the tab 73 and parallel to the apertures 79. A retaining clip 83 is affixed to the leg 81 once it is inserted into the apertures 82 so as to retain the pin 78 relative to the cover 68 regardless of whether it is in its locked position as shown in the figures or in the released position, as will be described.

An elastomeric damping member 85 is affixed to the thermostat housing 64 and engages the underside of the cover portion 71, adjacent the recess 72, so as to provide support for this portion of the cover. The cover portion 71 has a depending flange 86 formed with a recess 87 that is complementary to the elastomeric member 85 so as to provide transverse location for this portion of the cover 68.

The extreme end of the cover portion 71 is formed with a pair of integral depending hook-like parts 88 at its opposite sides. These hook-like parts 88 are adapted to snap fit over respective pins 89 formed on the engine 32 so as to complete the attachment between the cover 68 and the engine 32.

The drawings illustrate the cover 68 and the outer cowling removable main cover portion 24 in position.

In the event it is desired to emergency start the engine 32, the main cowling removable cover portion 24 is removed by releasing the clamps 36 and raising the cover 24 from the tray 23. As has been previously noted, the supporting panel 47 will be retained in place during this time. Removal of the main cover portion 24 permits access to the flywheel cover 68. The flywheel cover 68 may be released, without the use of any tools, by sliding the retaining pin 78 in a direction toward the top as viewed in FIG. 3. The pin 78 is normally retained in its locked position by the cooperation of detent portions 91 formed on the cover adjacent the opening 79 with detent recesses 92 formed in the pin leg 77. However, due to the resilience of the portion which defines the detent projections 91, the pin 78 may be so withdrawn. Complete withdrawal of the pin, however, is precluded by the retaining clip 83.

Once the pin 78 has been withdrawn clear of the apertures 75 and 76 in the mounting bracket 37 and mounting panel 47, the forward portion of the cover may be raised sufficiently so as to permit disengagement of the hook-shaped portion 88 from the pins 89. Hence, the cover 68 may be conveniently removed so that a rope 57 can be wound around the flywheel recess between the gear 55 and the flange 56 so as to permit emergency manual starting. The reinstallation of the flywheel cover 68 and outer cowling main cover portion 24 is believed to be obvious.

Embodiment Of FIGS. 9 Through 13

A combined flywheel, pulley and belt cover constructed in accordance with another embodiment of the invention is identified generally by the reference numeral 101. The cover 101 is adapted to be affixed directly to the engine as in the embodiment of FIGS. 1 through 8 and the basic configuration of the engine and the protective cowling of the power head is the same as in that embodiment. For that reason, only those components necessary to understand the construction and operation of this embodiment and the manner of attachment of the cover 101 to the engine 32 is illustrated and will be described.

As with the previously described embodiment, the cover 101 is formed from a suitable material such as molded fiberglass and has a generally cylindrical portion 102 that is adapted to encircle and protect the flywheel magneto assembly. Adjacent to one side of the portion 102, a generally oval section 103 is provided which overlies the belt and pulley that is affixed to the camshaft.

A mounting tab portion 104 is formed integrally with the cylindrical portion 102 on the side opposite to the oval shaped portion 103. The portion 104 is formed with a recess 105 that receives the bracket 37 and the supporting panel 47. In this embodiment, the mounting tab portion 104 has only a single aligned pair of apertures 106. These apertures 106 are aligned with the openings 75 of the mounting bracket 37 and the aperture 76 of the panel 47. A long leg 107 of a retaining pin assembly, indicated generally by the reference numeral 108, extends through the apertures 106, 75 and 76 so as to fix the upper end of the supporting panel 47 to the bracket 37 and so as to affix the cover 101 to the engine 32.

The pin 108 has a generally L shape and its short leg 109 is received within a complementary recess 111 formed adjacent the tab 104 so as to provide a snap fit to retain the locking pin 107 in the respective apertures.

Adjacent the thermostat housing 64, the cover portion 103 is formed with an opening 112 in which a grommet 113 is received. The grommet 113 in turn has a central opening 114 that passes a collar 115. The collar 115 itself has a central opening to receive a threaded shaft of a knurl headed screw 116. The threads of the screw are threaded into a tapped opening 117 formed in the thermostat housing 64 so as to affix the center portion of the cover 101 relative to the engine 32 and additionally affording some vibration damping, as in the previously described embodiment.

The extreme ends of the cover portion 103 are provided with a pair of integral lugs 118 which define downwardly oopening U shaped recesses 119. These recesses 119 engage resilient grommets 121 that are carried by outwardly extending pins 122 formed on the engine 32.

It should be readily apparent that the connection of the cover 101 to the engine 32 is achieved through an elastic arrangement so as to afford some vibration damping. In addition, as with the embodiment of FIGS. 1 through 8, the cover 101 may be conveniently removed without the use of any tools. This is done by rotating the retaining pin 108 so that its short leg 109 is no longer contained within the recess 111. The pin 108 may then be withdrawn. At the same time, the knurled screw 116 is removed by hand without a tool so that the cover 101 may be lifted off of the engine 32 for emergency starting. Reinstallation is achieved in the opposite sequence.

It should be readily apparent from the foregoing description that two embodiments of the invention have been disclosed wherein a simple yet highly effective cover is provided for the flywheel and driving belt and sprocket of the camshaft of the engine. However, the cover in each embodiment may be readily removed for emergency starting without the necessity of using any tools.

Although two embodiments of the invention have been illustrated and described, various changes and modifications may be made, without departing from the spirit and scope of the invention, as defined by the appended claims.

What is claimed is:

1. A cowling arrangement for the power head of an outboard motor which outboard motor is adapted to be attached as a unit to an associated watercraft, said unit comprising an internal combustion engine having an output shaft carrying a flywheel, a ring gear carried by said flywheel and cooperable with a first starter for normal starting of said engine, an outer cowling enclosing said engine and having a readily removable portion disposed contiguous to said flywheel, and a flywheel cover enclosing said flywheel and detachably connected to said engine independent of said readily removable outer cowling portion for retention thereof relative to said engine upon removal of said readily removable outer cowling portion, an emergency rope starter associated with said flywheel and having a manually operable pull member for emergency starting of said engine, said emergency rope starter and said manually operable pull member completely enclosed by said flywheel cover, said flywheel cover being detachably connected to said engine for removal thereof without the use of any tool for access to said emergency starter.

2. A cowling arrangement as set forth in claim 1 further including a pulley driven by the engine output shaft via a belt, the flywheel cover having an integral portion thereof enclosing said pulley and said drive belt.

3. A cowling arrangement as set forth in claim 2 wherein the pulley drives a camshaft of the engine.

4. A cowling arrangement for the power head of an outboard motor which outboard motor is adapted to be attached as a unit to an associated watercraft, said outboard motor unit comprising an internal combustion engine having an output shaft carrying a flywheel, an outer cowling enclosing said engine and having a readily removable portion disposed contiguous to said flywheel, and a flywheel cover enclosing said flywheel and detachably connected to said engine independent of said readily removable outer cowling portion for retention thereof relative to said engine upon removal of said readily removable outer cowling portion, said flywheel cover being detachably connected to said engine for removal thereof without the use of any tool, said outer cowling comprises a lower tray affixed to said engine, a supporting panel affixed to said tray and extending upwardly therefrom, said outer cowling readily removable portion having an opening receiving said panel and permitting removal of said outer cowling removable portion with said panel in place, and a supporting bracket affixed to said supporting panel, the means for detachably connecting said flywheel cover to said engine including a pin passing through said flywheel cover, the supporting bracket and said panel for affixing said cover, panel and supporting bracket to each other.

5. A cowling arrangement as set forth in claim 4 wherein the pin has a U-shape and further including a retaining clip for retaining said pin relative to the flywheel cover.

6. A cowling arrangement as set forth in claim 4 wherein the pin has a generally L shape, the cover being provided with a detent recess for retaining the short leg of the pin for detachably affixing the pin to said flywheel cover.

7. A cowling arrangement as set forth in claim 5 further including vibration means interposed between the cover and the engine at a point spaced from the pin.

8. A cowling arrangement as set forth in claim 6 further including vibration means interposed between the cover and the engine at a point spaced from the pin.

* * * * *